US010306354B2

(12) United States Patent
Zhou et al.

(10) Patent No.: US 10,306,354 B2
(45) Date of Patent: May 28, 2019

(54) LOUDSPEAKER MODULE

(71) Applicant: GOERTEK INC., WeiFang (CN)

(72) Inventors: Shuzhi Zhou, WeiFang (CN); Jun Zhang, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/570,288

(22) PCT Filed: Nov. 16, 2015

(86) PCT No.: PCT/CN2015/094676
§ 371 (c)(1),
(2) Date: Oct. 27, 2017

(87) PCT Pub. No.: WO2016/173240
PCT Pub. Date: Nov. 3, 2016

(65) Prior Publication Data

US 2018/0124508 A1 May 3, 2018

(30) Foreign Application Priority Data

Apr. 29, 2015 (CN) ..... 2015 1 0210290

(51) Int. Cl.
*H04R 1/28* (2006.01)

(52) U.S. Cl.
CPC ..... *H04R 1/2888* (2013.01); *H04R 1/2811* (2013.01); *H04R 1/288* (2013.01)

(58) Field of Classification Search
CPC ..... H04R 1/2888; H04R 1/2811; H04R 1/288
See application file for complete search history.

(56) References Cited

U.S. PATENT DOCUMENTS 6,811,431 B2 * 11/2004 Hsieh ..... H01R 13/03 381/322
2001/0017929 A1 * 8/2001 Wong ..... H04R 9/02 381/405
2006/0233417 A1 10/2006 Steere et al.
2012/0269373 A1 * 10/2012 Slotte ..... H04M 1/035 381/353

(Continued)

FOREIGN PATENT DOCUMENTS

CN 204291379 U 4/2015
CN 104811856 A 7/2015
CN 204616051 U 9/2015

OTHER PUBLICATIONS

International Search Report for International Patent Application No. PCT/CN2015/094676, filed on Nov. 16, 2015.

*Primary Examiner* — Tuan D Nguyen

(57) ABSTRACT

A loudspeaker module comprises a housing and a loudspeaker unit. A cavity for accommodating and fixing the loudspeaker unit is provided in the housing. The loudspeaker unit divides the cavity into a front and rear sound cavity. A sound hole is provided on the housing, which is connected to the front sound cavity by a sound channel, and the loudspeaker unit has a square structure. The sound channel comprises an inner end close to the loudspeaker unit and an outer end communicated with the sound hole. The width of the inner end is longer than three fifths of the length of a side, corresponding to the inner end, of the loudspeaker unit. The loudspeaker module of the present invention has the advantage of good acoustic performance.

7 Claims, 2 Drawing Sheets

(56) References Cited

U.S. PATENT DOCUMENTS

| | | | | |
|---|---|---|---|---|
| 2015/0256922 | A1* | 9/2015 | Shi | H04R 1/2842<br>381/353 |
| 2015/0304747 | A1* | 10/2015 | Wang | H04R 5/02<br>381/345 |
| 2016/0295316 | A1* | 10/2016 | Shao | H04R 1/025 |

* cited by examiner

LOUDSPEAKER MODULE

CROSS-REFERENCE TO RELATED APPLICATIONS

The present specification is a U.S. National Stage of International Patent Application No. PCT/CN2015/094676 filed Nov. 16, 2015, which claims priority to and the benefit of Chinese Patent Application No. 201510210290.7 filed in the Chinese Intellectual Property Office on Apr. 29, 2015, the entire contents of which are incorporated herein by reference.

TECHNICAL FIELD

The present invention relates to the field of electro-acoustics, and more particularly to a loudspeaker module with an excellent acoustic performance.

BACKGROUND

At present, the distortion performance of a loudspeaker module is increasingly emphasized, and the full-frequency band of sound distortion of the loudspeaker module is required to be as low as possible. In the structural design of the loudspeaker module in the prior art, it is preferable to firstly ensure the volume of the rear cavity of the loudspeaker module, and then determine the size of the sound channel of the front cavity. This may lead to a narrow inner sound hole, close to the loudspeaker unit, of the sound channel, which makes the sound channel narrow and the sound not smooth, and leads to increase the high frequency distortion, thereby decreasing the acoustic performance of the loudspeaker module.

Therefore, it is necessary to propose an improvement to overcome the shortcomings of the conventional loudspeaker modules.

SUMMARY

The technical problem sought to be solved by the present invention is to provide a loudspeaker module with an excellent acoustic performance.

In order to achieve the above objective, the present invention adopts the following technical solution:

A loudspeaker module comprises a housing and a loudspeaker unit. A cavity for accommodating and fixing the loudspeaker unit is provided in the housing. The loudspeaker unit divides the cavity into a front sound cavity and a rear sound cavity. A sound hole is provided on the housing, the sound hole is connected to the front sound cavity by a sound channel, and the loudspeaker unit is of a square structure. The sound channel comprises an inner end close to the loudspeaker unit and an outer end communicated with the sound hole. A width of the inner end is longer than three fifths of the length of a side, corresponding to the inner end, of the loudspeaker unit.

As a preferred embodiment, the sound hole is provided in a side wall of the housing.

As a preferred embodiment, the outer side of the housing is provided with a dust screen at a position corresponding to the sound hole.

As a preferred embodiment, the housing is provided with a damping hole at a position corresponding to the rear cavity, and the damping hole is provided with a damping mesh.

As a preferred embodiment, the housing is provided with a steel sheet at a position corresponding to the mounting position of the loudspeaker unit.

As a preferred embodiment, the loudspeaker unit is provided with an electric connecting piece, the loudspeaker module further comprises a flexible circuit board, and the electric connecting piece is electrically connected to the flexible circuit board.

As a preferred embodiment, the housing comprises a first housing and a second housing, and the sound hole is jointly formed by the first housing and the second housing.

In the loudspeaker module of the invention, a sound hole is provided on the housing, the front cavity is communicated with the sound hole by the sound channel. The loudspeaker unit is of a square structure. The width of the sound channel close to the inner end of the loudspeaker unit is longer than three-fifths of the length of the side, corresponding to the inner side, of the loudspeaker unit. The loudspeaker module of the present invention defines the width of one end of the sound channel close to the loudspeaker unit, and the width is in proportion with the length of the corresponding side of the loudspeaker unit, which can ensure the sound smooth, and effectively reduce the high frequency distortion of the loudspeaker module. By means of the structural design of the loudspeaker module of the present invention, the technical problem that high frequency distortion of the loudspeaker module is relatively higher is solved, the acoustic quality of the loudspeaker module is effectively improved, an airflow sound produced by the impact of a sound airflow on a sound channel is reduced, and a sound produced by the loudspeaker module is clearer, purer and kinder. Therefore, the loudspeaker module of the present invention has an advantage of a good acoustic performance.

DETAILED DESCRIPTION OF THE PREFERRED EMBODIMENTS

The present invention will be described in detail with reference to the accompanying drawings.

Figure 1:
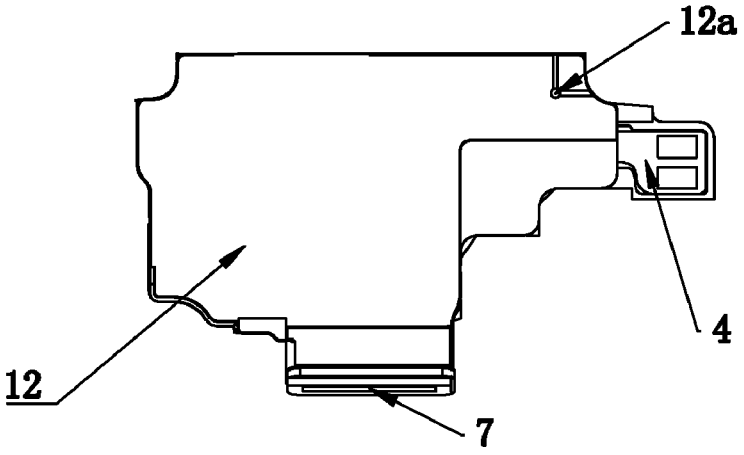
FIG. 1 is a bottom view of a specific embodiment of the loudspeaker module of the present invention.
Figure 2:
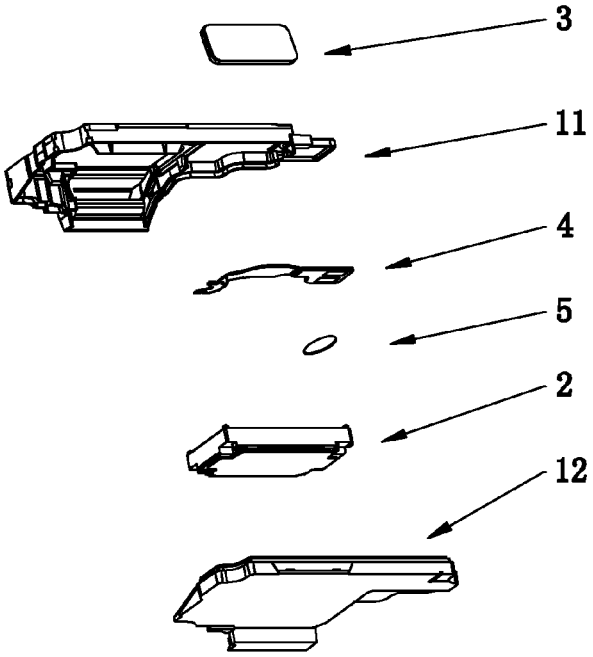
FIG. 2 is an exploded view of the loudspeaker module shown in FIG. 1.

As shown in FIG. 2, the loudspeaker module of the present invention comprises a housing comprising a first housing 11 and a second housing 12. The first housing 11 and the second housing 12 cooperate to accommodate and fix a loudspeaker unit 2. The loudspeaker unit 2 divides a cavity formed by the first housing 11 and the second housing 12 into a front sound cavity and a rear sound cavity (not shown), and the front sound cavity is communicated with the sound hole of the loudspeaker unit 2. As shown in FIG. 1, the housing of the loudspeaker module of the present invention is provided with a sound hole 7, and the sound hole 7 is communicated with the front sound cavity. In the loudspeaker module of the present invention, the sound produced by the loudspeaker unit 2 enters the front sound cavity by the sound hole of the loudspeaker unit 2 and is transmitted to the outside of the loudspeaker module by the sound hole 7 of the module.

Figure 3:
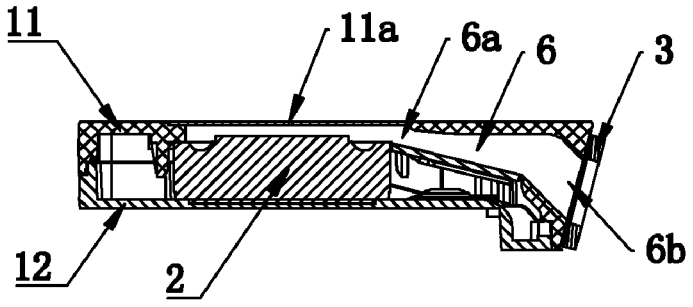
FIG. 3 is a cross-sectional view of the loudspeaker module shown in FIG. 1.
Figure 4:
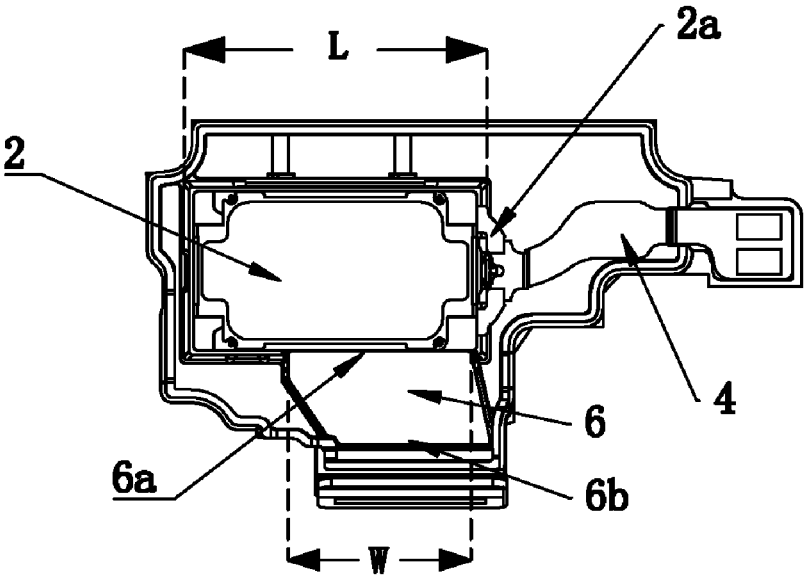
FIG. 4 is a schematic view of the internal structure of the loudspeaker module shown in FIG. 1.

As shown in FIGS. 3 and 4, in the loudspeaker module of the present invention, the sound hole 7 is communicated with the front sound cavity by the sound channel 6, and as shown in FIGS. 2 and 4, the loudspeaker unit 2 is of a square structure. As shown in FIG. 4, the sound channel 6 comprises an inner end 6*a* close to the loudspeaker unit 2 and an outer end 6*b* communicated with the sound hole. The length of the side of the loudspeaker unit 2 close to the inner end 6*a* is L, the width of the inner end 6*a* is W, and the width W of the inner end 6*a* is longer than three fifths of the length L of the side. As the width of the inner end 6*a* is longer than three fifths of the length of the side, corresponding to the inner end 6*a*, of the loudspeaker unit 2, it is possible to ensure that the loudspeaker module sounds smoothly, the high frequency distortion of the loudspeaker module is reduced effectively, the acoustic performance of the loudspeaker module is improved, an airflow sound produced by the impact of a sound airflow on a sound channel is reduced, and a sound produced by the loudspeaker module is clearer, purer and kinder. Therefore, the loudspeaker module of the present invention has an advantage of good acoustic performance.

As shown in FIG. 1, in the loudspeaker module of the present embodiment, the sound hole 7 is provided in a side wall of the housing of the loudspeaker module. As the sound hole is provided in the sidewall, the thickness of the loudspeaker module may be reduced, which facilitates the miniaturization design of the loudspeaker module.

As shown in FIG. 3, the outside of the housing of the module is provided with a dust screen 3 at a position corresponding to the sound hole. The dust screen 3 can prevent foreign matters from entering into the inside of the loudspeaker module, thereby improving the reliability of the loudspeaker module.

As shown in FIG. 1, the housing of the loudspeaker module is provided with a damping hole 12*a* at a position corresponding to the rear cavity. A damping mesh 5 is provided in the damping hole 12*a*. The damping hole 12*a* can ensure the air pressure balance between the front sound cavity and the rear sound cavity of the loudspeaker module and the normal vibration of the diaphragm of the loudspeaker unit 2, thereby improving the acoustic performance of the loudspeaker module.

As shown in FIG. 3, in the loudspeaker module of the present embodiment, the first housing 11 is provided with a steel sheet 11*a* at a position corresponding to the loudspeaker unit 2, and the steel sheet 11*a* can reduce the thickness of the housing while ensuring rigidity of the housing, thereby increasing the internal space of the loudspeaker module, increasing the volume of the loudspeaker unit 2, improving the sound effect of the loudspeaker unit 2, and improving the acoustic performance of the loudspeaker module.

As shown in FIG. 4, the loudspeaker module of the present embodiment further comprises a flexible circuit board 4. The loudspeaker unit is provided with an electric connecting piece 2*a*, and the electric connecting piece 2*a* is electrically coupled to the flexible circuit board 4. The loudspeaker unit 2 is electrically connected to the external circuit through the flexible circuit board 4.

As shown in FIG. 3, in the loudspeaker module of the present embodiment, the sound hole is formed by the cooperation of the first housing 11 and the second housing 12, so the difficulty of the housing design is simplified and the production efficiency of the housing is improved.

In the loudspeaker module of the invention, the sound hole is provided on the housing, the front cavity is communicated with the sound hole through the sound channel. The loudspeaker unit is of a square structure. The width of the sound channel close to the inner end of the loudspeaker unit is longer than three-fifths of the length of the side, corresponding to the inner side, of the loudspeaker unit. The loudspeaker module of the present invention defines the width of one end of the sound channel close to the loudspeaker unit, and the width is in proportion with the length of the corresponding side of the loudspeaker unit, which can ensure the sound smooth, and effectively reducing the high frequency distortion of the loudspeaker module. By means of the structural design of the loudspeaker module of the present invention, the technical problem that high frequency distortion of the loudspeaker module is relatively higher is solved, the acoustic quality of the loudspeaker module is effectively improved, an airflow sound produced by the impact of a sound airflow on a sound channel is reduced, and a sound produced by the loudspeaker module is clearer, purer and kinder.

The above mentioned are only the embodiment of the present invention and are not for limiting the present invention, thus the equivalent modification or variation made by those skilled in the art according to the present invention should be incorporated into the protection scope recited in the claims.

The invention claimed is:

1. A loudspeaker module comprising a housing and a loudspeaker unit, wherein a cavity for accommodating and fixing the loudspeaker unit is provided in the housing, the loudspeaker unit divides the cavity into a front sound cavity and a rear sound cavity, a sound hole is provided on the housing, the sound hole is connected to the front sound cavity by a sound channel, wherein the loudspeaker unit is of a square structure, the sound channel comprises an inner end close to the loudspeaker unit and an outer end communicated with the sound hole, and a width of the inner end is longer than three fifths of a length of a side, corresponding to the inner end, of the loudspeaker unit, wherein the sound channel includes only one channel from the inner end to the outer end thereof, and wherein the inner end of the second channel is located at an upper side of the front sound cavity above a side surface of the loudspeaker unit close to the inner end.

2. The loudspeaker module according to claim 1, wherein the sound hole is provided in a side wall of the housing.

3. The loudspeaker module according to claim 2, wherein an outer side of the housing is provided with a dust screen at a position corresponding to the sound hole.

4. The loudspeaker module according to claim 1, wherein the housing is provided with a damping hole at a position corresponding to the rear sound cavity, and the damping hole is provided with a damping mesh.

5. The loudspeaker module according to claim 1, wherein the housing is provided with a steel sheet at a position corresponding to the mounting position of the loudspeaker unit.

6. The loudspeaker module according to claim 1, wherein the loudspeaker unit is provided with an electric connecting piece, the loudspeaker module further comprises a flexible circuit board, and the electric connecting piece is electrically coupled to the flexible circuit board.

7. The loudspeaker module according to claim 1, wherein the housing comprises a first housing and a second housing, and the sound hole is jointly formed by the first housing and the housing.

* * * * *